US005143563A

United States Patent [19]

Krueger et al.

[11] Patent Number: 5,143,563

[45] Date of Patent: Sep. 1, 1992

[54] CREEP, STRESS RUPTURE AND HOLD-TIME FATIGUE CRACK RESISTANT ALLOYS

[75] Inventors: Daniel D. Krueger; Jeffrey F. Wessels, both of Cincinnati, Ohio; Keh-Minn Chang, Schenectady, N.Y.

[73] Assignee: General Electric Company, Cincinnati, Ohio

[21] Appl. No.: 417,098

[22] Filed: Oct. 4, 1989

[51] Int. Cl.[5] ..... C22C 19/05; C22F 1/10

[52] U.S. Cl. ..... 148/410; 148/428; 148/675

[58] Field of Search ..... 420/448; 148/2, 3, 12.7 N, 148/162, 410; 428/680, 678; 416/241 R

[56] References Cited

U.S. PATENT DOCUMENTS

| | | | |
|---|---|---|---|
| Re. 29,920 | 2/1979 | Baldwin | 75/134 |
| 3,046,108 | 7/1962 | Eiselstein | 75/171 |
| 3,061,426 | 10/1962 | Bieber | 75/171 |
| 3,151,981 | 10/1964 | Smith et al. | 75/171 |
| 3,343,950 | 9/1967 | Richards et al. | 75/171 |
| 3,576,681 | 4/1971 | Barker et al. | 148/32 |
| 4,207,098 | 6/1980 | Shaw | 75/171 |
| 4,318,753 | 3/1982 | Anderson et al. | 148/3 |
| 4,624,716 | 11/1986 | Noel et al. | 148/12.7 |
| 4,769,087 | 9/1988 | Genereux et al. | 148/2 |
| 4,816,084 | 3/1989 | Chang | 148/13 |
| 4,820,358 | 4/1989 | Chang | 148/13 |
| 4,908,069 | 3/1990 | Doherty et al. | 148/12.7 N |

*Primary Examiner*—R. Dean
*Assistant Examiner*—Margery S. Phipps
*Attorney, Agent, or Firm*—Carmen Santa Maria; Jerome C. Squillaro

[57] ABSTRACT

Improved, creep-stress rupture and hold-time fatigue resistant nickel base alloys for use at elevated temperatures are disclosed. The alloys consists essentially of, in weight percent, 10.9 to 12.9% Co; 11.8 to 13.8% Cr; 4.6 to 5.6% Mo; 2.1 to 3.1% Al; 4.4 to 5.4% Ti; 1.1 to 2.1% Nb; 0.005 to 0.025% B; 0.01 to 0.06% C; 0 to 0.6% Zr; 0.1 to 0.3% Hf; balance nickel. The article is characterized by a microstructure having an average grain size of from about 20 to 40 microns, with carbides, borides, and 0.3 to 0.4 micron-sized coarse gamma prime located at the grain boundaries, and 30 nanometer-sized fine gamma prime uniformly distributed throughout the grains. The alloys are suitable for use as turbine disks in gas turbine engines of the type used in jet engines, or for use as rim sections of dual alloy turbine disks for advanced turbine engines and are capable of operation at temperatures up to about 1500° F. A method for achieving the desired properties in such turbine disks is also disclosed.

10 Claims, 6 Drawing Sheets

CREEP, STRESS RUPTURE AND HOLD-TIME FATIGUE CRACK RESISTANT ALLOYS

RELATED APPLICATIONS

The following commonly assigned applications are directed to related subject matter and are being concurrently filed with the present application, the disclosures of which are hereby incorporated herein by reference:

Ser. No. 07,417,095;

Ser. No. 07/417,096;

Ser. No. 07/417,097.

This invention relates to gas turbine engines for aircraft, and more particularly to materials used in turbine disks which support rotating turbine blades in advanced gas turbine engines operated at elevated temperatures in order to increase performance and efficiency.

BACKGROUND OF THE INVENTION

Turbine disks used in gas turbine engines employed to support rotating turbine blades encounter different operating conditions radially from the center or hub portion to the exterior or rim portion. The turbine blades and the exterior portion of the disk are exposed to combustion gases which rotate the turbine disk. As a result, the exterior or rim portion of the disk is exposed to a higher temperature than the hub or bore portion. The stress conditions also vary across the face of the disk. Until recently, it has been possible to design single alloy disks capable of satisfying the varying stress and temperature conditions across the disk. However, increased engine efficiency in modern gas turbines as well as requirements for improved engine performance now dictate that these engines operate at higher temperatures. As a result, the turbine disks in these advanced engines are exposed to higher temperatures than in previous engines, placing greater demands upon the alloys used in disk applications. The temperatures at the exterior or rim portion may be 1500° F. or higher, while the temperatures at the bore or hub portion will typically be lower, e.g., of the order of 1000° F.

In addition to this temperature gradient across the disk, there is also a variation in stress, with higher stresses occurring in the lower temperature hub region, while lower stresses occur in the high temperature rim region in disks of uniform thickness. These differences in operating conditions across a disk result in different mechanical property requirements in the different disk regions. In order to achieve the maximum operating conditions in an advanced turbine engine, it is desirable to utilize a disk alloy having high temperature creep and stress rupture resistance as well as high temperature hold time fatigue crack growth resistance in the rim portion and high tensile strength, and low cycle fatigue crack growth resistance in the hub portion.

Current design methodologies for turbine disks typically use fatigue properties, as well as conventional tensile, creep and stress rupture properties for sizing and life analysis. In many instances, the most suitable means of quantifying fatigue behavior for these analyses is through the determination of crack growth rates as described by linear elastic fracture mechanics ("LEFM"). Under LEFM, the rate of fatigue crack propagation per cycle (da/dN) is a function which may be affected by temperature and which can be described by the stress intensity range, $\Delta K$, defined as $K_{max}-K_{min}$. $\Delta K$ serves as a scale factor to define the magnitude of the stress field at a crack tip and is given in general form as $\Delta K = f(\text{stress, crack length, geometry})$.

Complicating the fatigue analysis methodologies mentioned above is the imposition of a tensile hold in the temperature range of the rim of an advanced disk. During a typical engine mission, the turbine disk is subject to conditions of relatively frequent changes in rotor speed, combinations of cruise and rotor speed changes, and large segments of cruise component. During cruise conditions, the stresses are relatively constant resulting in what will be termed a "hold time" cycle. In the rim portion of an advanced turbine disk, the hold time cycle may occur at high temperatures where environment, creep and fatigue can combine in a synergistic fashion to promote rapid advance of a crack from an existing flaw. Resistance to crack growth under these conditions, therefore, is a critical property in a material selected for application in the rim portion of an advanced turbine disk.

For improved disks, it has become desirable to develop and use materials which exhibit slow, stable crack growth rates, along with high tensile, creep, and stress-rupture strengths. The development of new nickel-base superalloy materials which offer simultaneously the improvements in and an appropriate balance of tensile, creep, stress-rupture, and fatigue crack growth resistance, essential for advancement in the aircraft gas turbine art, presents a sizeable challenge. The challenge results from the competition between desirable microstructures, strengthening mechanisms, and composition features. The following are typical examples of such competition: (1) a fine grain size, for example, a grain size smaller than about ASTM 10, is typically desirable for improving tensile strength, but not creep/stress-rupture, and crack growth resistance; (2) small shearable precipitates are desirable for improving fatigue crack growth resistance under certain conditions, while shear resistant precipitates are desirable for high tensile strength; (3) high precipitate-matrix coherency strain is typically desirable for good stability, creep-rupture resistance, and probably good fatigue crack growth resistance; (4) generous amounts of refractory elements such as W, Ta or Nb can significantly improve strength, but must be used in moderate amounts to avoid unattractive increases in alloy density and to avoid alloy instability; (5) in comparison to an alloy having a low volume fraction of the ordered gamma prime phase, an alloy having a high volume fraction of the ordered gamma prime phase generally has increased creep/rupture strength and hold time resistance, but also increased risk of quench cracking and limited low temperature tensile strength.

Once compositions exhibiting attractive mechanical properties have been identified in laboratory scale investigations, there is also a considerable challenge in successfully transferring this technology to large full-scale production hardware, for example, turbine disks of diameters up to, but not limited to, 25 inches. These problems are well known in the metallurgical arts.

A major problem associated with full-scale processing of Ni-base superalloy turbine disks is that of cracking during rapid quench from the solution temperature. This is most often referred to as quench cracking. The rapid cool from the solution temperature is required to obtain the strength required in disk applications, especially in the bore region. The bore region of a disk, however, is also the region most prone to quench cracking because of its increased thickness and thermal stresses compared to the rim region. It is desirable that an alloy for turbine disk applications in a dual alloy turbine disk be resistant to quench cracking.

Many of the current superalloys intended for use as disks in gas turbine engines operating at lower temperatures have been developed to achieve a satisfactory combination of high resistance to fatigue crack propagation, strength, creep and stress rupture life at these temperatures. An example of such a superalloy is found in the commonly-assigned U.S. Pat. No. 4,888,064. While such a superalloy is acceptable for rotor disks operating at lower temperatures and having less demanding operating conditions than those of advanced engines a superalloy for use in the hub portion of a rotor disk at the higher operating temperatures and stress levels of advanced gas turbines desirably should have a lower density and a microstructure having different grain boundary phases as well as improved grain size uniformity. Such a superalloy should also be capable of being joined to a superalloy which can withstand the severe conditions experienced in the hub portion of a rotor disk of a gas turbine engine operating at lower temperatures and higher stresses. It is also desirable that a complete rotor disk in an engine operating at lower temperatures and/or stresses be manufactured from such a superalloy.

As used herein, yield strength ("Y.S.") is the 0.2% offset yield strength corresponding to the stress required to produce a plastic strain of 0.2% in a tensile specimen that is tested in accordance with ASTM specifications E8 ("Standard Methods of Tension Testing of Metallic Materials," Annual Book of ASTM Standards, Vol. 03.01, pp. 130–150, 1984) or equivalent method and E21. The term ksi represents a unit of stress equal to 1,000 pounds per square inch.

The term "balance essentially nickel" is used to include, in addition to nickel in the balance of the alloy, small amounts of impurities and incidental elements, which in character and/or amount do not adversely affect the advantageous aspects of the alloy.

SUMMARY OF THE INVENTION

An object of the present invention is to provide a superalloy with sufficient tensile, creep and stress rupture strength, hold time fatigue crack resistance and low cycle fatigue resistance for use in a unitary turbine disk for a gas turbine engine.

Another object of this invention is to provide a superalloy having sufficient low cycle fatigue resistance, hold time fatigue crack resistance as well as sufficient tensile, creep and stress rupture strength for use as an alloy for a rim portion of a dual alloy turbine disk of an advanced gas turbine engine and which is capable of operating at temperatures as high as about 1500° F.

In accordance with the foregoing objects, the present invention is achieved by providing an alloy having a composition, in weight percent, of about 10.7% to about 19.2% cobalt, about 10.8% to about 14.0% chromium, about 3.3% to about 5.8% molybdenum, about 1.9% to about 4.7% aluminum, about 3.3% to about 5.6% titanium, about 0.9% to about 2.7% niobium, about 0.005% to about 0.042% boron, about 0.010% to about 0.062% carbon, zirconium in an amount from 0 to about 0.062%, optionally hafnium to about 0.32% and the balance essentially nickel. The range of elements in the compositions of the present invention provide superalloys characterized by enhanced hold time fatigue crack growth rate resistance, stress/rupture resistance, and creep resistance at temperatures up to and including about 1500° F.

Various methods for processing the alloys of the present invention may be employed. Preferably, however, high quality alloy powders are manufactured by a process which includes vacuum induction melting ingots of the composition of the present invention and subsequently atomizing the liquid metal in an inert gas atmosphere to produce powder. Such powder, preferably at a particle size of about 106 microns (0.0041 inches) and less, is subsequently loaded under vacuum into a stainless steel can and sealed or consolidated by a compaction and extrusion process to yield a billet having two phases, a gamma matrix and a gamma prime precipitate.

The billet may preferably be forged into a preform using an isothermal closed die forging method at any suitable elevated temperature below the solvus temperature.

The preferred heat treatment of the alloy combinations of the present invention requires solution treating of the alloy above the gamma prime solvus temperature, but below the point at which substantial incipient melting occurs. It is held within this temperature range for a length of time sufficient to permit complete dissolution of any gamma prime into the gamma matrix. It is then cooled from the solution temperature at a rate suitable to prevent quench cracking while obtaining the desired properties, followed by an aging treatment suitable to maintain stability for an application at 1500° F. Alternatively, the alloy can first be machined into articles which are then given the above-described heat treatment.

The treatment for these alloys described above typically yields a microstructure having average grain sizes of about 20 to about 40 microns in size, with some grains as large as about 90 microns. The grain boundaries are frequently decorated with gamma prime, carbide and boride particles. Intragranular gamma prime is approximately 0.3–0.4 microns in size. The alloys also typically contain fine-aged gamma prime approximately 30 nanometers in size uniformly distributed throughout the grains.

Articles prepared from the alloys of the invention in the above manner are resistant to stress rupture and creep at elevated temperatures up to and including about 1500° F. Articles prepared in the above manner from the alloys of the invention also exhibit an improvement in hold time fatigue crack growth ("FCG") rate of about fifteen times over the corresponding FCG rate of a commercially available disk superalloy at 1200° F. and even more significant improvements at 1400° F.

The alloys of the present invention can be processed by various powder metallurgy processes and may be used to make articles for use in gas turbine engines, for example, turbine disks for gas turbine engines operating at conventional temperatures and bore stresses. The alloys of this invention are particularly suited for use in the rim portion of a dual alloy disk for advanced gas turbine engines.

DETAILED DESCRIPTION OF THE INVENTION

Figure 1:
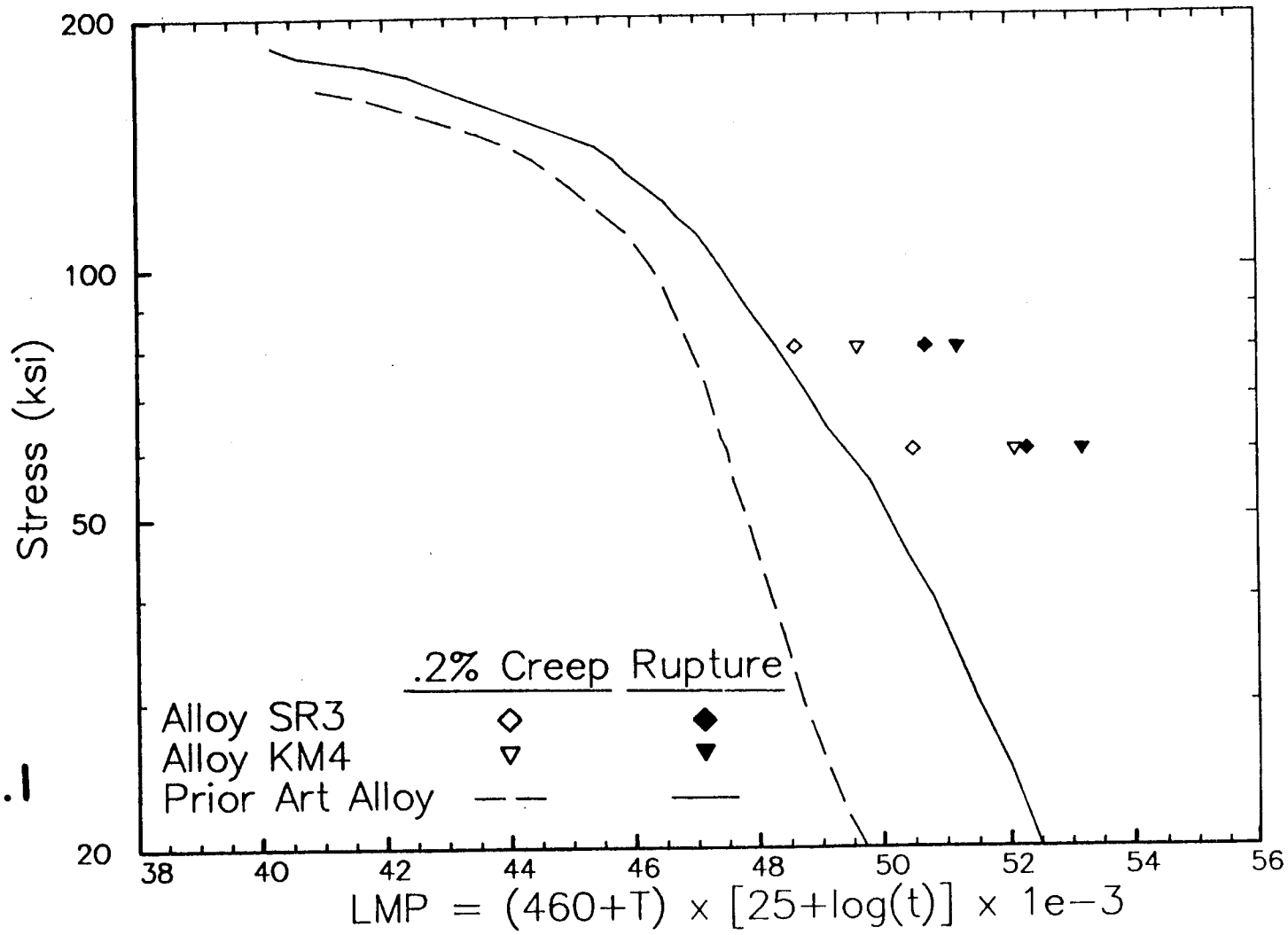
FIG. 1 is a graph of stress rupture strength versus the Larson-Miller Parameter for the alloys of the present invention.

Pursuant to the present invention, superalloys which have good creep and stress rupture resistance, good tensile strength at elevated temperatures, and good fatigue crack resistance are provided. The superalloys of the present invention can be processed by the compaction and extrusion of metal powder, although other processing methods, such as conventional powder metallurgy processing, wrought processing, casting or forging may be used.

The present invention also encompasses a method for processing a superalloy to produce material with a superior combination of properties for use in turbine engine disk applications, and more particularly, for use as a rim in an advanced turbine engine disk capable of operation at temperatures as high as about 1500° F. When used as a rim in a turbine engine disk, as discussed in related application Ser. No. 07/417,096, the rim must be joined to a hub, which hub is the subject of related application Ser. No. 07/417,097 and which joining is the subject of related application Ser. No 07/417,095. Thus, it is important that the alloys used in the hub and the rim be compatible in terms of the following:

(1) chemical composition (e.g. no deleterious phases forming at the interface of the hub and the rim);

(2) thermal expansion coefficients; and (3) dynamic modulus value.

It is also desirable that the alloys used in the hub and the rim be capable of receiving the same heat treatment while maintaining their respective characteristic properties. The alloys of the present invention satisfy those requirements when matched with the hub alloys of related application Ser. No. 07/417,097.

It is known that some of the most demanding properties for superalloys are those which are needed in connection with gas turbine construction. Of the properties which are needed, those required for the moving parts of the engine are usually greater than those required for static parts.

Although the tensile properties of a rim alloy are not as critical as for a hub alloy, use of the alloys of the present invention as a single alloy disk requires acceptable tensile properties since a single alloy must have satisfactory mechanical properties across the entire disk to satisfy varying operating conditions across the disk.

Nickel-base superalloys having moderate-to-high volume fractions of gamma prime are more resistant to creep and to crack growth than such superalloys having low volume fractions of gamma prime. Enhanced gamma prime content can be accomplished by increasing relative amounts of gamma prime formers such as aluminum, titanium and niobium. Because niobium has a deleterious effect on the quench crack resistance of superalloys, the use of niobium to increase the strength must be carefully adjusted so as not to deleteriously affect quench crack resistance. The moderate-to-high volume fraction of gamma prime in the superalloys of the present invention also contribute to a slightly lower density of the alloy because the gamma prime contains larger amounts of less dense alloys such as aluminum and titanium. A dense alloy is undesirable for use in aircraft engines where weight reduction is a major consideration. The density of the alloys of the present invention, Alloy SR3 and Alloy KM4, is about 0.294 pounds per cubic inch and about 0.288 pounds per cubic inch respectively. The volume fractions of gamma prime of the alloys of the present invention are calculated to be between about 34% to about 68%. The volume fraction of gamma prime in Alloy SR3 is about 49% and the volume fraction of gamma prime in Alloy KM4 is about 54%. Molybdenum, cobalt and chromium are also used to promote improved creep behavior and oxidation resistance and to stabilize the gamma prime precipitate.

The alloys of the present invention are up to about fifteen times more resistant to hold time fatigue crack propagation than a commercially-available disk superalloy having a nominal composition of about 13% chromium, about 8% cobalt, about 3.5% molybdenum, about 3.5% tungsten, about 3.5% aluminum, about 2.5% titanium, about 3.5% niobium, about 0.03% zirconium, about 0.03% carbon, about 0.015% boron and the balance essentially nickel, used in gas turbine disks and familiar to those skilled in the art. These alloys also show significant improvement in creep and stress rupture behavior at elevated temperatures as compared to this superalloy.

The creep and stress rupture properties of the present invention are illustrated in the manner suggested by Larson and Miller (see Transactions of the A.S.M.E., 1952, Volume 74, pages 765–771). The Larson-Miller method plots the stress in ksi as the ordinate and the Larson-Miller Parameter ("LMP") as the abscissa for graphs of creep and stress rupture. The LMP is obtained from experimental data by the use of the following formula:

$$LMP=(T+460)\times[25+\log(t)]\times 10^{-3}$$

where

LMP = Larson-Miller Parameter

T = temperature in °F.

t = time to failure in hours.

Using the design stress and temperature in this formulation, it is possible to calculate either graphically or mathematically the design stress rupture life under these conditions. The creep and stress rupture strength of the alloys of the present invention are shown in FIG. 1. These creep and stress-rupture properties are an improvement over the aforementioned commercially-available disk superalloy by about 195° F. at 60 ksi and about 88° F. at 80 ksi.

Crack growth or crack propagation rate is a function of the applied stress ($\sigma$) as well as the crack length (a). These two factors are combined to form the parameter known as stress intensity, K, which is proportional to the product of the applied stress and the square root of the crack length. Under fatigue conditions, stress intensity in a fatigue cycle represents the maximum variation of cyclic stress intensity, $\Delta K$, which is the difference between maximum and minimum K. At moderate temperatures, crack growth is determined primarily by the cyclic stress intensity, $\Delta K$, until the static fracture toughness $K_{IC}$ is reached. Crack growth rate is expressed mathematically as $$\frac{da}{dN} \alpha (\Delta K)^n$$

where

N = number of cycles n = constant, $2 \leqq n \leqq 4$

K = cyclic stress intensity a = crack length

The cyclic frequency and the temperature are significant parameters determining the crack growth rate. Those skilled in the art recognize that for a given cyclic stress intensity at an elevated temperature, a slower cyclic frequency can result in a faster fatigue crack growth rate. This undesirable time dependent behavior of fatigue crack propagation can occur in most existing high strength superalloys at elevated temperatures.

The most undesirable time-dependent crack-growth behavior has been found to occur when a hold time is imposed at peak stress during cycling. A test sample may be subjected to stress in a constant cyclic pattern, but when the sample is at maximum stress, the stress is held constant for a period of time known as the hold time. When the hold time is completed, the cyclic application of stress is resumed. According to this hold time pattern, the stress is held for a designated hold time each time the stress reaches a maximum in following the cyclic pattern. This hold time pattern of application of stress is a separate criteria for studying crack growth and is an indication of low cycle fatigue life. This type of hold time pattern was described in a study conducted under contract to the National Aeronautics and Space Administration identified as NASA CR-165123 entitled "Evaluation of the Cyclic Behavior of Aircraft Turbine Disk Alloys", Part II, Final Report, by B. Towles, J. R. Warren and F. K. Hauhe, dated August 1980.

Depending on design practice, low cycle fatigue life can be considered to be a limiting factor for the components of gas turbine engines which are subject to rotary motion or similar periodic or cyclic high stress. If an initial, sharp crack-like flaw is assumed, fatigue crack growth rate is the limiting factor of cyclic life in turbine disks.

It has been determined that at low temperatures the fatigue crack propagation depends essentially entirely on the intensity at which stress is applied to components and parts of such structures in a cyclic fashion. The crack growth rate at elevated temperatures cannot be determined simply as a function of the applied cyclic stress intensity range $\Delta K$. Rather, the fatigue frequency can also affect the propagation rate. The NASA study demonstrated that the slower the cyclic frequency, the faster a crack grows per unit cycle of applied stress. It has also been observed that faster crack propagation occurs when a hold time is applied during the fatigue cycle. Time-dependence is a term which is applied to such cracking behavior at elevated temperatures where the fatigue frequency and hold time are significant parameters.

Testing of fatigue crack growth resistance of the alloys of the present invention indicate an improvement of thirty times over the previously mentioned commercially-available disk superalloy at 1200° F. and even more significant improvements at over this commercially-available superalloy at 1400° F. using 90 second hold times and the same cyclic loading rates as used in 20 cpm (1.5 seconds) tests.

Tensile strength of a nickel base superalloy measured by UTS and YS must be adequate to meet the stress levels in the central portion of a rotating disk. Although the tensile properties of the alloys of the present invention are lower than the aforementioned commercially-available disk superalloy, the tensile strength is adequate to withstand the stress levels encountered in the rim of advanced gas turbine engines and across the entire diameter of disks of gas turbine engines operating at lower temperatures.

In order to achieve the properties and microstructures of the present invention, processing of the superalloys is important. Although a metal powder was produced which was subsequently processed using a compaction and extrusion method followed by a heat treatment, it will be understood to those skilled in the art that any method and associated heat treatment which produces the specified composition, grain size and microstructure may be used.

Solution treating may be performed at any temperature above which gamma prime dissolves in the gamma matrix and below the incipient melting temperature of the alloy. The temperature at which gamma prime first begins to dissolve in the gamma matrix is referred to as the gamma prime solvus temperature, while the temperature range between the gamma prime solvus temperature and the incipient melting temperature is referred to as the supersolvus temperature range. The supersolvus temperature range will vary depending upon the actual composition of the superalloy. The superalloys of this invention were solution-treated in the range of about 2110° F. to about 2190° F. for about 1 hour. This solution treatment was followed by an aging treatment at a temperature of about 1500° F. to about 1550° F. for about 4 hours.

EXAMPLE 1

Twenty-five pound ingots of the following compositions were prepared by a vacuum induction melting and casting procedure:

TABLE I

| | Composition of Alloy SR3 | |
|---|---|---|
| | Wt. % | Tolerance Range in Wt. % |
| Co | 11.9 | ±1.0 |
| Cr | 12.8 | ±1.0 |
| Mo | 5.1 | ±0.5 |
| Al | 2.6 | ±0.5 |
| Ti | 4.9 | ±0.5 |
| Nb | 1.6 | ±0.5 |
| B | 0.015 | ±0.01 |
| C | 0.030 | +0.03 −0.02 |
| Zr | 0.030 | ±0.03 |
| Hf | 0.2 | ±0.1 |

TABLE I-continued

| | Composition of Alloy SR3 | |
|---|---|---|
| | Wt. % | Tolerance Range in Wt. % |
| Ni | Balance | |

A powder was then prepared by melting ingots of the above composition in an argon gas atmosphere and atomizing the liquid metal using argon gas. This powder was then sieved to remove powders coarser than 150 mesh. This resulting sieved powder is also referred to as −150 mesh powder.

The −150 mesh powder was next transferred to consolidation cans. Initial densification of the alloy was performed using a closed die compaction procedure at a temperature approximately 150° F. below the gamma prime solvus followed by extrusion using a 7:1 extrusion reduction ratio at a temperature approximately 100° F. below the gamma prime solvus to produce fully dense extrusions.

The extrusions were then solution treated above the gamma prime solvus temperature in the range of about 2140° F. to about 2160° F. for about one hour. This supersolvus solution treatment completely dissolves the gamma prime phase and forms a well-annealed structure. This solution treatment also recrystallizes and coarsens the fine-grained billet structure and permits controlled re-precipitation of the gamma prime during subsequent processing.

The solution-treated extrusions were then rapidly cooled from the solution treatment temperature using a controlled quench. This quench should be performed at a rate as fast as possible without forming quench cracks while causing a uniform distribution of gamma prime throughout the structure. A controlled fan helium quench having a cooling rate of approximately 250° F. per minute was actually used.

Following quenching, the alloy was aged using an aging treatment in the temperature range of about 1500° F. to about 1550° F. for about 4 hours. The preferred temperature range for this treatment for Alloy SR3 is 1515° F. to about 1535° F. This aging promotes the uniform distribution of additional gamma prime and is suitable for an alloy designed for about 1500° F. service.

Figure 2:
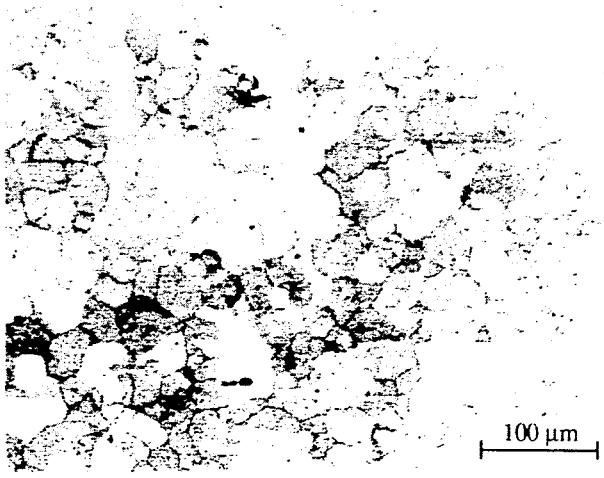
FIG. 2 is an optical photomicrograph of Alloy SR3 at approximately 200 magnification after full heat treatment.
Figure 3:
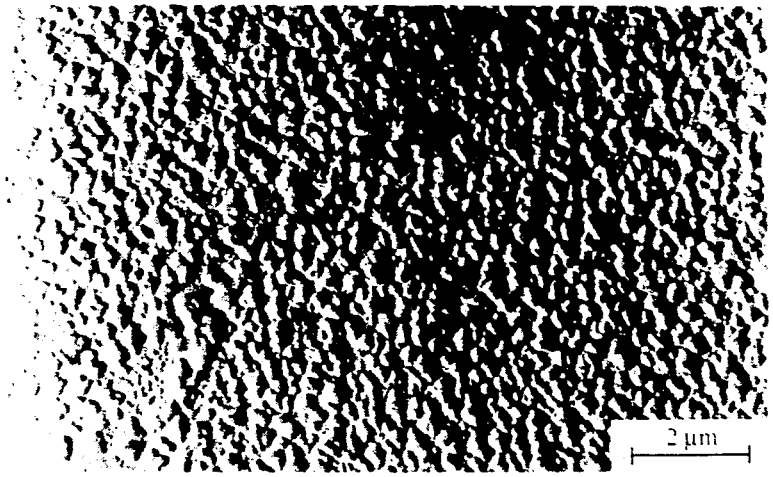
FIG. 3 is a transmission electron microscope replica of Alloy SR3 at approximately 10,000 magnification after full heat treatment.
Figure 4:
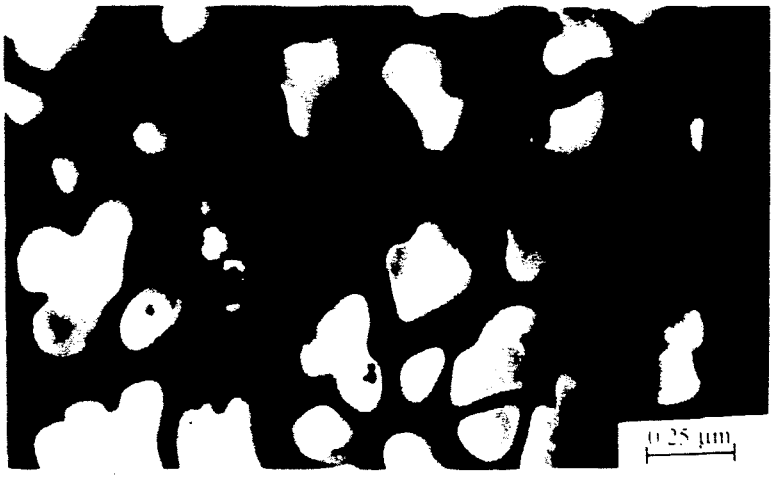
FIG. 4 is a transmission electron microscope dark field micrograph of Alloy SR3 at approximately 60,000 magnification after full heat treatment.

Referring now to FIGS. 2–4, the microstructural features of Alloy SR3 after full heat treatment are shown. FIG. 2, a photomicrograph of the microstructure of Alloy SR3, shows that the average grain size is from about 20 to about 40 microns, although an occasional grain may be large as about 90 microns in size. As shown in FIG. 3, residual, irregularly-shaped intragranular gamma prime that nucleated early during cooling and subsequently coarsened is distributed throughout the grains. This gamma prime, as well as carbide particles and boride particles, is located at grain boundaries. This gamma prime is approximately 0.40 microns and is observable in FIGS. 3 and 4. The uniformly-distributed fine aging, or secondary, gamma prime that formed during the 1525° F. aging treatment is approximately 30 nanometers in size and is observable in FIG. 4 as small, white particles distributed among the larger intragranular gamma prime. The higher temperature of the aging treatment for Alloy SR3 produces a slightly larger secondary gamma prime than a typical aging treatment at about 1400° F./8 hours currently used for bore alloys operating at lower temperature.

Figure 5:
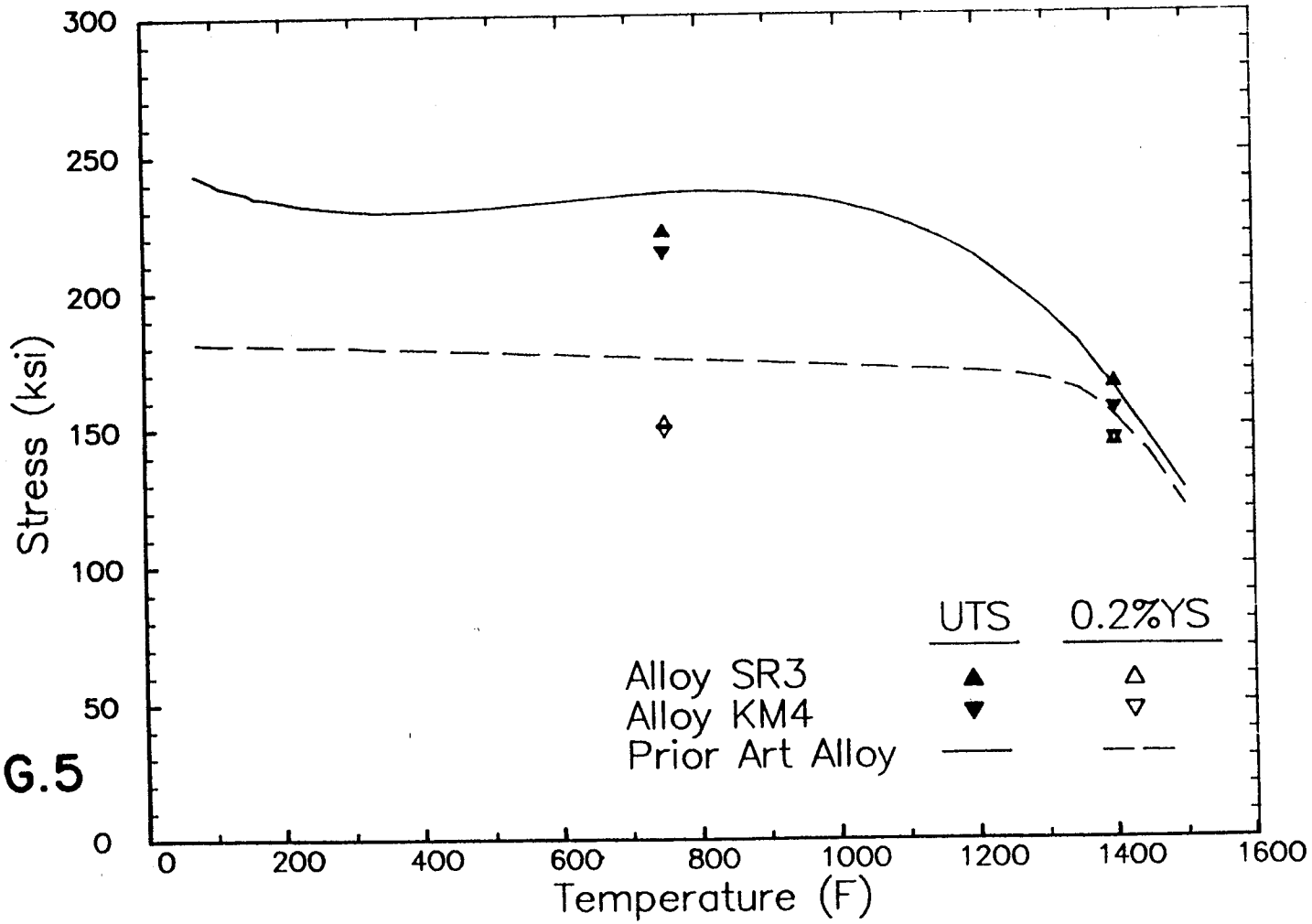
FIG. 5 is a graph in which ultimate tensile strength ("UTS") and yield strength ("YS") of Alloys SR3 and KM4 (in ksi) are plotted as ordinates against temperature (in degrees Fahrenheit) as abscissa.

FIG. 5 shows UTS and YS of Alloy SR3. Although these strengths are lower than those of the aforementioned commercially-available disk superalloy, they are sufficient to satisfy the strength requirements of a disk for a gas turbine engine operating at lower temperatures and stresses and for use as the rim alloy of a dual alloy disk.

Figure 6:
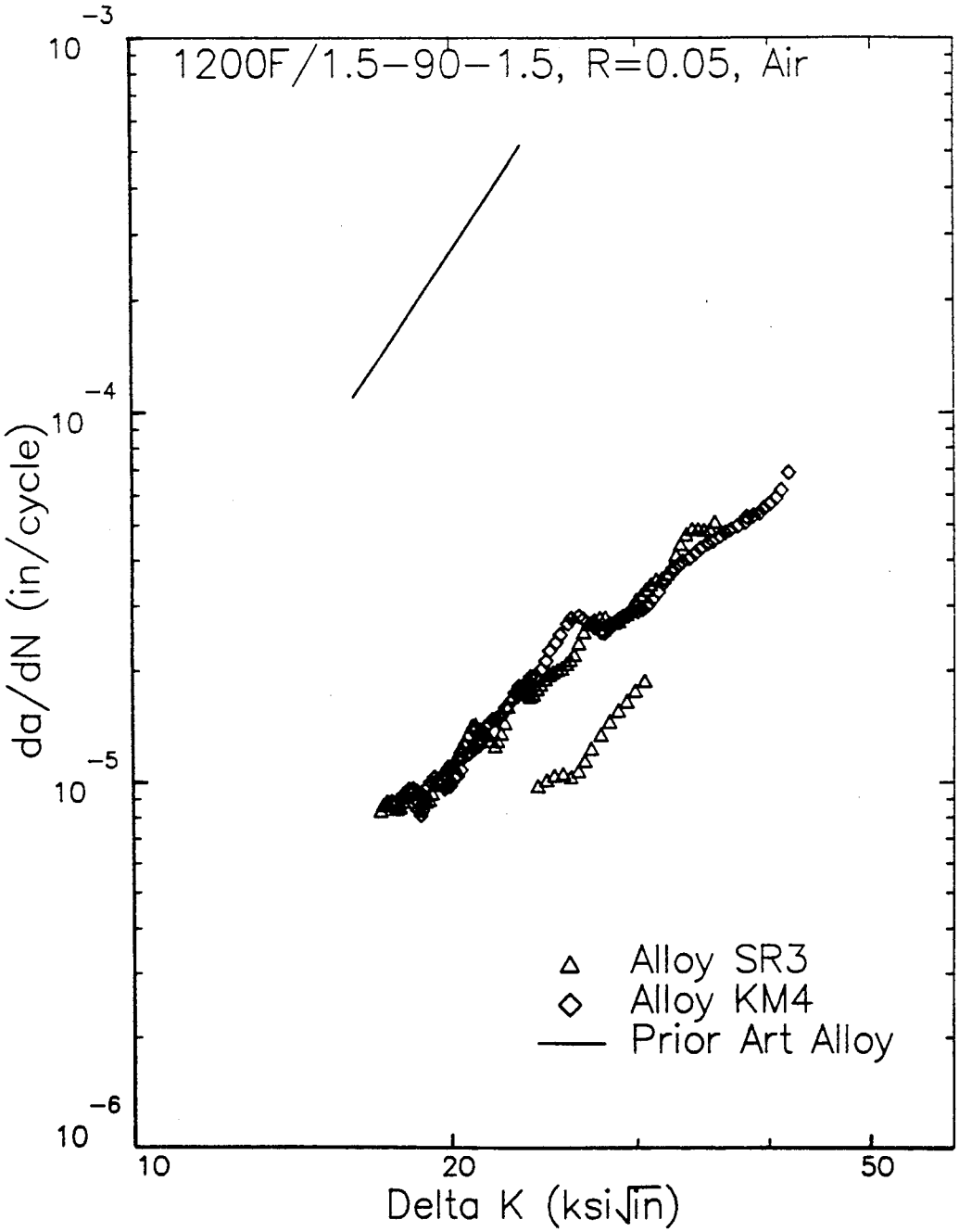
FIGS. 6 and 7 are graphs (log-log plots) of hold time fatigue crack growth rates (da/dN) obtained at 1200° F. and 1400° F. at various stress intensities (delta K) for Alloys SR3 and KM4 using 90 second hold times and 1.5 second cyclic loading rates.
Figure 7:
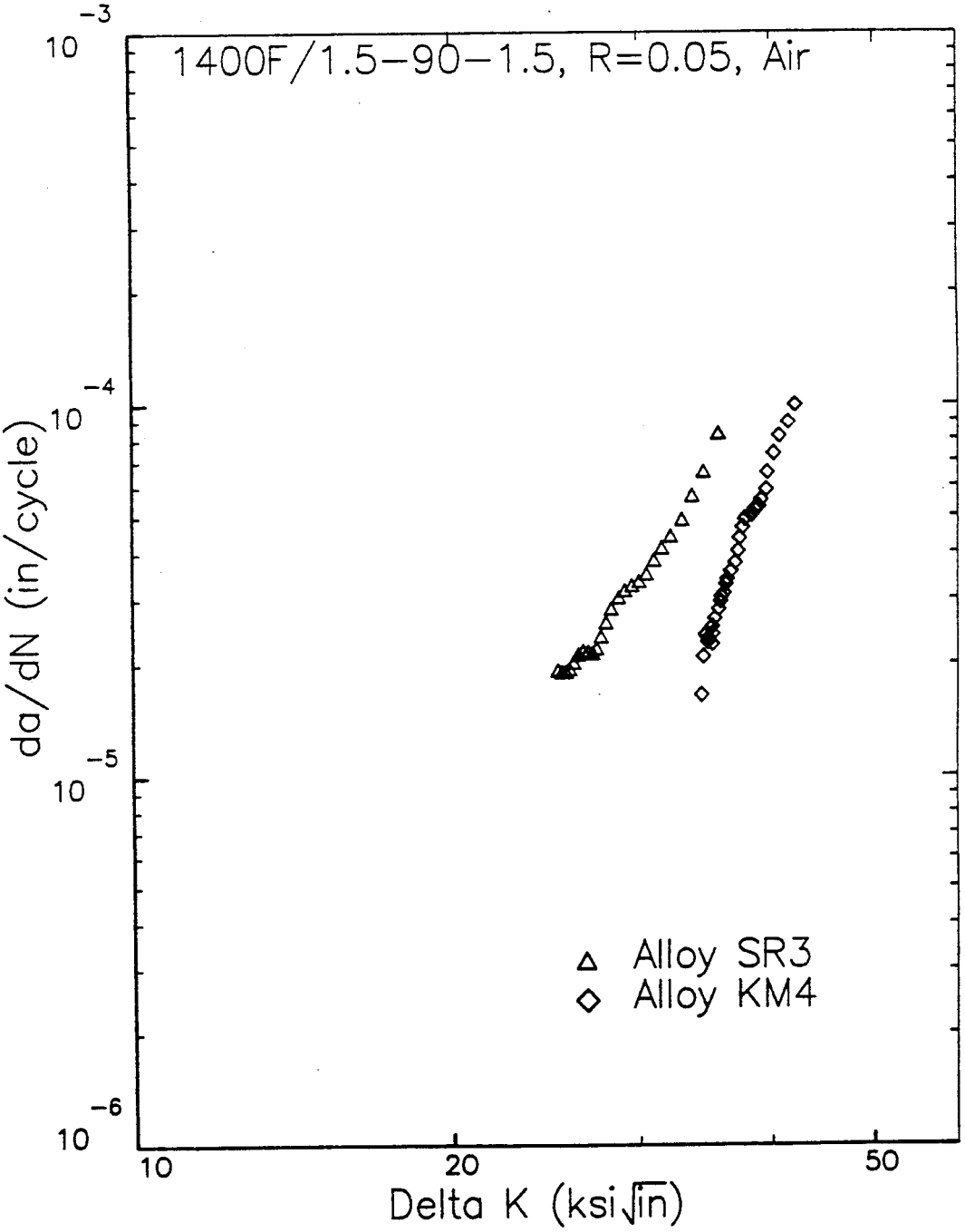

FIG. 6 is a graph of the hold-time fatigue crack growth behavior of Alloy SR3 as compared to the aforementioned commercially-available disk superalloy at 1200° F. using 1.5 second cyclic loading rates and 90 second hold times. FIG. 7 is a graph of the hold time fatigue crack growth behavior of Alloy SR3 and Alloy KM4 at 1400° F. using 1.5 second cyclic loading rates and 90 second hold times. The hold time fatigue crack growth behavior is significantly improved over the aforementioned commercially-available disk superalloy, being an improvement of about 30 times at 1200° F. and an even more significant improvement at 1400° F.

FIG. 1 is a graph of the creep and stress rupture strength of Alloy SR3. The creep and stress rupture strength of Alloy SR3 is superior to the creep and stress rupture strength of the reference commercially-available disk superalloy, being an improvement of about 73° F. at 80 ksi and about 170° F. at 60 ksi.

When Alloy SR3 is used as a rim in an advanced turbine it must be combined with a hub alloy. These alloys must have compatible thermal expansion capabilities. When Alloy SR3 is used as a single alloy disk in a turbine, the thermal expansion must be such that no interference with adjacent parts occurs when used at elevated temperatures. The thermal expansion behavior of Alloy SR3 is shown in Table II; it may be seen to be compatible with the hub alloys described in related application Ser. No. 07/417,097, of which Rene'95 is one.

TABLE II

| | Total Thermal Expansion (× 1.0 E-3 in./in.) at Temperature (°F.) | | | | | | |
|---|---|---|---|---|---|---|---|
| Alloy | 75° F. | 300° F. | 750° F. | 1000° F. | 1200° F. | 1400° F. | 1600° F. |
| SR3 | — | 1.5 | 4.9 | 6.9 | 8.7 | 10.6 | 13.0 |
| R'95 | — | 1.6 | 4.8 | 6.8 | 8.6 | 10.6 | — |

EXAMPLE 2

Twenty-five pound ingots of the following compositions were prepared by a vacuum induction melting and casting procedure:

TABLE III

| | Composition of Alloy KM4 | |
|---|---|---|
| | Wt % | Tolerance Range Wt % |
| Co | 18.0 | ±1.0 |
| Cr | 12.0 | ±1.0 |
| Mo | 4.0 | ±0.5 |
| Al | 4.0 | ±0.5 |
| Ti | 4.0 | ±0.5 |
| Nb | 2.0 | ±0.5 |
| B | 0.03 | +0.01 −0.02 |
| C | 0.03 | +0.03 −0.02 |
| Zr | 0.03 | ±0.03 |
| Ni | Balance | |

A powder was then prepared by melting ingots of the above composition in an argon gas atmosphere and atomizing the liquid metal using argon gas. This powder was then sieved to remove powders coarser than 150 mesh. This resulting sieved powder is also referred to as −150 mesh powder.

The −150 mesh powder was next transferred to consolidation cans where initial densification was performed using a closed die compaction procedure at a temperature approximately 150° F. below the gamma prime solvus, followed by extrusion using a 7:1 extrusion reduction ratio at a temperature approximately 100° F. below the gamma prime solvus to produce fully dense extrusions.

The extrusions were then solution treated above the gamma prime solvus temperature in the range of about 2140° F. to about 2160° F. for about 1 hour. This supersolvus solution treatment completely dissolves the gamma prime phase and forms a well-annealed structure. This solution treatment also recrystallizes and coarsens the fine-grained billet structure and permits controlled re-precipitation of the gamma prime during subsequent processing.

The solution-treated extrusions were then rapidly cooled from the solution treatment temperature using a controlled quench. This quench must be performed at a rate sufficient to develop a uniform distribution of gamma prime throughout the structure. A controlled fan helium quench having a cooling rate of approximately 250° F. per minute was actually used.

Following quenching, the alloy was aged using an aging treatment in the temperature range of about 1500° F. to about 1550° F. for about 4 hours. The preferred temperature range for this treatment for Alloy KM4 is 1515° F. to about 1535° F. This aging promotes the uniform distribution of additional gamma prime and is suitable for an alloy designed for about 1500° F. service.

Figure 8:
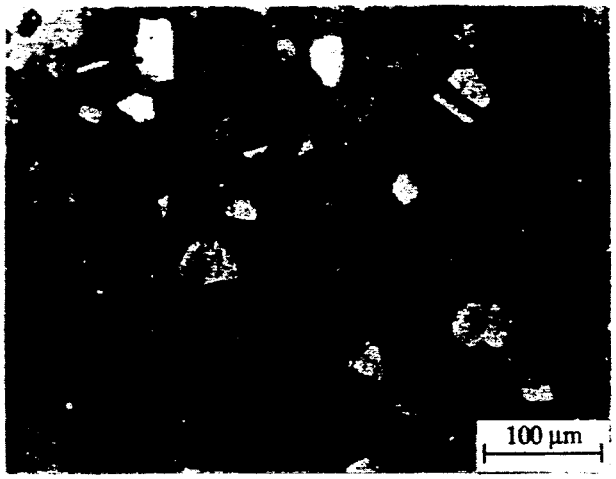
FIG. 8 is an optical photomicrograph of Alloy KM4 at approximately 200 magnification after full heat treatment.
Figure 9:
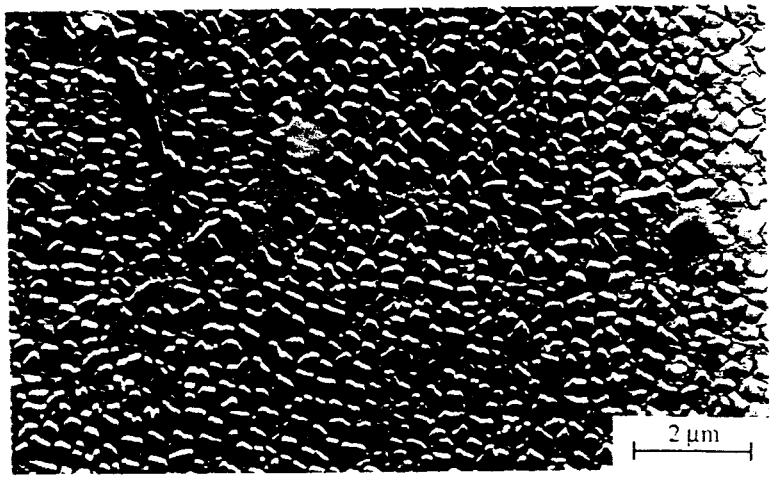
FIG. 9 is a transmission electron microscope replica of Alloy KM4 at approximately 10,000 magnification after full heat treatment.
Figure 10:
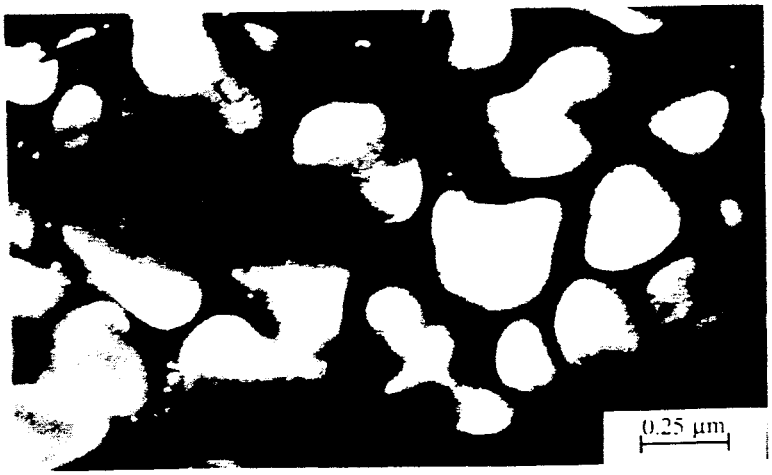
FIG. 10 is a transmission electron microscope dark field micrograph of Alloy KM4 at approximately 60,000 magnification after full heat treatment.

Referring now to FIGS. 8–10, the microstructural features of alloy KM4 after full heat treatment are shown. FIG. 8, a photomicrograph of the microstructure of Alloy KM4, shows that the average size of most of the grains is from about 20 to about 40 microns, although a few of the grains are as large as about 90 microns. As shown in FIG. 9, residual cuboidal-shaped gamma prime that nucleated early during cooling and subsequently coarsened is distributed throughout the grains. This type of gamma prime, as well as carbide particles and boride particles, is located at grain boundaries. The gamma prime that formed on cooling is approximately 0.3 microns and is observable in FIGS. 9 and 10. The uniformly distributed fine aging, or secondary, gamma prime that formed during the 1525° F. aging treatment is approximately 30 nanometers in size and is observable in FIG. 10 as small, white particles distributed among the larger primary gamma prime. The higher temperature of the aging treatment produces a slightly larger secondary gamma prime than a standard aging treatment at about 1400° F. and provides stability of the microstructure at correspondingly higher temperatures.

FIG. 5 shows the UTS and YS of Alloy KM4. Although these strengths are lower than those of the reference commercially-available disk superalloy, they are sufficient to satisfy the strength requirements of a disk of a gas turbine engine operating at lower temperatures and stresses and for use as the rim alloy of a dual alloy disk.

FIG. 6 is a graph of the hold-time fatigue crack growth behavior of Alloy KM4 as compared to the aforementioned commercially-available disk alloy at 1200° F. using 1.5 second cyclic loading rates and 90 second hold times. FIG. 7 is a graph of the hold time fatigue crack growth behavior of Alloy KM4 at 1400° F. using 1.5 second cyclic loading rates and 90 second hold times. The hold time fatigue crack growth behavior of Alloy KM4 is improved over that of the commercially-available disk superalloy by about thirty times at 1200° F. and is even more significantly improved at 1400° F.

FIG. 1 is a graph of the creep and stress rupture strength of Alloy KM4. The creep and stress rupture life of Alloy KM4 is superior to the creep and stress rupture life of the reference commercially-available disk superalloy by about 100° F. at 80 ksi and at least 220° F. at 60 ksi.

When Alloy KM4 is used as a rim in an advanced turbine it must be combined with a hub alloy. These alloys must have compatible thermal expansion capabilities. When Alloy KM4 is used as a disk in a gas turbine engine, the thermal expansion must be such that no interference with adjacent parts occurs when used at elevated temperatures. The thermal expansion behavior of Alloy KM4 is shown in Table IV; it may be seen to be compatible with the hub alloys described in related application Ser. No. 07/417,097, of which Rene'95 is one.

TABLE IV

| | Total Thermal Expansion (× 1.0 E-3 in./in.) at Temperature (°F.) | | | | | | |
|---|---|---|---|---|---|---|---|
| Alloy | 75° F. | 300° F. | 750° F. | 1000° F. | 1200° F. | 1400° F. | 1600° F. |
| KM4 | — | 1.5 | 4.9 | 5.0 | 8.8 | 10.8 | 13.2 |
| R'95 | — | 1.6 | 4.8 | 6.8 | 8.6 | 10.6 | — |

EXAMPLE 3

Alloy SR3 was prepared in a manner identical to that described in Example 1, above, except that, following quenching from the supersolvus solution treatment temperature, the alloy was aged for about eight hours in the temperature range of about 1375° F. to about 1425° F. The tensile properties of Alloy SR3 aged in this temperature range are given in Table V. The creep-rupture properties for this Alloy aged at this temperature are given in Table VI and the fatigue crack growth rates are given in Table VII.

TABLE V

| Alloy SR3 Tensile Properties (1400° F./8 Hour Age) | | |
|---|---|---|
| Temperature(°F.) | UTS(ksi) | YS(ksi) |
| 75 | 239.4 | 169.3 |
| 750 | 226.7 | 159.3 |
| 1000 | 226.1 | 155.1 |
| 1200 | 218.6 | 148.8 |
| 1400 | 171.9 | 147.3 |

TABLE VI

| Alloy SR3 Creep-Rupture Properties (1400° F./8 Hour Age) | | | | | |
|---|---|---|---|---|---|
| Temp. | Stress | Time to (hours) | | Larson-Miller Parameter | |
| (°F.) | (ksi) | 0.2% Creep | Rupture | 0.2% Creep | Rupture |
| 1200 | 135 | 660.0 | 1751.0 | 46.2 | 46.9 |
| 1400 | 80 | 36.0 | 201.5 | 49.4 | 50.8 |

TABLE VII

| Alloy SR3 Fatigue Crack Growth Rates (1400° F./8 Hour Age) | | | |
|---|---|---|---|
| | | da/DN Value at: | |
| Temp.(°F.) | Frequency | 20 ksi in | 30 ksi in |
| 1200 | 1.5-90-1.5 | 1.3 E-05 | 4.00 E-05 |
| 1400 | 1.5-90-1.5 | — | 1.5 E-05 |

The microstructure of Alloy SR3 aged for about eight hours in the temperature range of about 1400° F. is the same as Alloy SR3 aged for about four hours at about 1525° F. except that the gamma prime is slightly finer, being about 0.35 microns in size. The fine aged gamma prime is also slightly finer.

Alloy SR3, heat treated in the manner of this example, is suitable for use in disk applications up to about 1350° F., as, for example, a single alloy disk in a gas turbine operating at lower temperatures than the dual alloy disks proposed for use in advanced turbine engines.

EXAMPLE 4

Alloy KM4 was prepared in a manner identical to that described in Example 2, above, except that, following quenching from the supersolvus solution treatment temperature, the alloy was aged for about eight hours in the temperature range of about 1375° F. to about 1425° F. The tensile properties of Alloy KM4 aged in this temperature range are given in Table VIII. The creep-rupture properties for this Alloy aged at this temperature are given in Table IX and the fatigue crack growth rates are given in Table X.

TABLE VIII

| Alloy KM4 Tensile Properties (1400° F./8 Hour Age) | | |
|---|---|---|
| Temperature(°F.) | UTS(ksi) | YS(ksi) |
| 75 | 228.7 | 160.2 |
| 750 | 200.4 | 134.7 |
| 1200 | 202.5 | 145.7 |
| 1400 | 155.6 | 142.1 |

TABLE IX

| Alloy KM4 Creep-Rupture Properties (1400° F./8 Hour Age) | | | | | |
|---|---|---|---|---|---|
| Temp. | Stress | Time to (hours) | | Larson-Miller Parameter | |
| (°F.) | (ksi) | 0.2% Creep | Rupture | 0.2% Creep | Rupture |
| 1300 | 125 | 15.0 | 129.2 | 46.1 | 47.7 |
| 1350 | 100 | 32.0 | 291.6 | 48.0 | 49.7 |
| 1400 | 80 | 48.0 | 296.0 | 49.6 | 51.1 |

TABLE X

| Alloy KM4 Fatigue Crack Growth Rates (1400° F./8 Hour Age) | | | |
|---|---|---|---|
| | | da/DN Value at: | |
| Temp.(°F.) | Frequency | 20 ksi√in | 30 ksi√in |
| 1200 | 1.5-90-1.5 | 1.70 E-05 | 5.20 E-05 |

The microstructure of Alloy KM4 aged for about eight hours in the temperature range of about 1400° F. is the same as Alloy KM4 aged for about four hours at about 1525° F. except that the gamma prime is slightly finer, being about 0.25 microns in size. The fine aged gamma prime is also slightly smaller.

Alloy KM4, heat treated in the manner of this example, is suitable for use in disk applications up to about 1350° F., as, for example, a single alloy disk in a gas turbine operating at lower temperatures than the dual alloy disks proposed for use in advanced turbine engines.

In light of the foregoing discussion, it will be apparent to those skilled in the art that the present invention is not limited to the embodiments and compositions herein described. Numerous modifications, changes, substitutions and equivalents will now become apparent to those skilled in the art, all of which fall within the scope contemplated by the invention herein.

What is claimed is:

1. A stress rupture-resistant nickel base superalloy article having improved low cycle fatigue life at elevated temperatures, consisting essentially of, in weight percent, about 10.9% to about 12.9% cobalt, about 11.8% to about 13.8% chromium, about 4.6% to about 5.6% molybdenum, about 2.1% to about 3.1% aluminum, about 4.4% to about 5.4% titanium, about 1.1% to about 2.1% niobium, about 0.005% to about 0.025% boron, about 0.01% to about 0.06% carbon, up to about 0.06% zirconium, about 0.1% to about 0.3% hafnium, and the balance essentially nickel, the article characterized by a microstructure having an average grain size of from about 20 microns to about 40 microns, with coarse gamma prime having a size of about 0.3 to about 0.4 microns located at the grain boundaries, and fine intragranular gamma prime with a size of about 30 nanometers uniformly distributed throughout the grains, the article further characterized by a microstructure having carbides and borides located at the grain boundaries.

2. The article of claim 1 which has been supersolvus solution treated in the temperature range of about 2140° F. to about 2160° F. for a length of time of about 1 hour, followed by a rapid quench, followed by an aging treatment at a temperature of about 1515° F. to about 1535° F. for about 4 hours.

3. The article of claim 1 which has been supersolvus solution treated in the temperature range of about 2140° F. to about 2160° F. for a length of time of about 1 hour, followed by a rapid quench, followed by an aging treatment at a temperature of about 1375° F. to about 1425° F. for about 8 hours.

4. A stress rupture-resistant nickel base superalloy article having improved low cycle fatigue life at elevated temperatures, consisting essentially of, in weight percent: about 17.0% to about 19.0% cobalt, about 11.0% to about 13.0% chromium, about 3.5% to about 4.5% molybdenum, about 3.5% to about 4.5% aluminum, about 3.5% to about 4.5% titanium, about 1.5% to about 2.5% niobium, about 0.01% to about 0.04% boron, about 0.01% to about 0.06% carbon, up to about 0.06% zirconium and the balance essentially nickel, the article characterized by a microstructure having an average grain size of from about 20 microns to about 40 microns, with coarse gamma prime having a size of about 0.3 to about 0.4 microns located at the grain boundaries, and fine intragranular gamma prime with a size of about 30 nanometers uniformly distributed throughout the grains, the article further characterized by a microstructure having carbides and borides located at the grain boundaries.

5. The article of claim 4 which has been supersolvus solution treated in the temperature range of about 2165° F. to about 2185° F. for about 1 hour, followed by a rapid quench, followed by an aging treatment at a temperature of about 1515° F. to about 1535° F. for about 4 hours.

6. The article of claim 4 which has been supersolvus solution treated in the temperature range of about 2165° F. to about 2185° F. for about 1 hour, followed by a rapid quench, followed by an aging treatment at a temperature of about 1375° F. to about 1425° F. for about 8 hours.

7. An article for use in a gas turbine engine which has been prepared in accordance with claims 2 or 5.

8. The article of claim 7 wherein said article is a turbine disk for a gas turbine engine.

9. The article of claims 2 or 3 wherein said article is the rim portion of a turbine disk for a gas turbine engine.

10. The article of claims 5 or 6 wherein said article is the rim portion of a turbine disk for a gas turbine engine.

* * * * *